US005603417A

United States Patent [19]

Blair

[11] Patent Number: 5,603,417

[45] Date of Patent: Feb. 18, 1997

[54] BAG SEALING APPARATUS

[76] Inventor: Norman T. Blair, 2100 Devils Knob Rd., P.O. Box 85, Tiller, Oreg. 97484-0085

[21] Appl. No.: 402,833

[22] Filed: Mar. 13, 1995

[51] Int. Cl.[6] ..... A47G 29/00

[52] U.S. Cl. ..... 211/71; 248/95

[58] Field of Search ..... 211/71, 72, 46, 211/88, 89, 94; 24/30.5 R, 30.5 L; 220/23.4; 248/101, 95, 97, 99, 316.1, 316.2, 316.3, 316.7, 317; 383/13, 22, 42, 49, 68, 69; D9/434, 435, 455; 312/183, 184; 52/202, 222

[56] References Cited

U.S. PATENT DOCUMENTS

| | | | |
|---|---|---|---|
| 198,929 | 1/1878 | Christey | 24/563 |
| D. 257,070 | 9/1980 | Holmes | D99/34 |
| D. 264,689 | 6/1982 | Miller | D9/434 |
| D. 284,810 | 7/1986 | Kelemen, Sr. | D3/30.1 |
| D. 331,364 | 12/1992 | Barker et al. | D9/434 |
| D. 348,817 | 7/1994 | Demers | D8/90 |
| 468,257 | 2/1892 | Paige | 383/13 |
| 897,594 | 9/1908 | Craw | 383/68 |
| 1,127,384 | 2/1915 | Adams | 383/68 |
| 1,571,049 | 1/1926 | Gatchell | 220/23.4 |
| 2,336,503 | 12/1943 | Ringler | 383/69 |
| 2,601,568 | 6/1952 | Sussenbach et al. | 383/69 |
| 2,909,147 | 10/1959 | Crowder | 383/68 X |
| 3,141,221 | 7/1964 | Faulls, Jr. | 24/30.5 R |
| 3,266,711 | 8/1966 | Song | 383/13 |
| 3,381,883 | 5/1968 | Harris | 229/125.19 |
| 3,707,271 | 12/1972 | Sanchez et al. | 248/101 |
| 3,798,810 | 3/1974 | Brisson et al. | 211/46 X |
| 3,841,478 | 10/1974 | Wells et al. | 206/491 |
| 4,718,562 | 1/1988 | Winkler, Jr. | 211/94.5 |
| 4,787,522 | 11/1988 | Nocek et al. | 211/72 X |
| 4,832,290 | 5/1989 | Baglio | 248/95 |
| 4,871,264 | 10/1989 | Robbins, III et al. | 383/68 |
| 4,938,366 | 7/1990 | Carroll | 211/94 X |
| 4,986,000 | 1/1991 | Mills | 30/278 |
| 5,226,734 | 7/1993 | Scott et al. | 383/22 |
| 5,255,800 | 10/1993 | Kelly | 211/89 |
| 5,351,371 | 10/1994 | DeVeau, Jr. et al. | 24/563 X |
| 5,354,132 | 10/1994 | Young et al. | 383/49 |
| 5,467,949 | 11/1995 | Lemke | 211/71 X |

*Primary Examiner*—Leslie A. Braun
*Assistant Examiner*—Sandra Snapp
*Attorney, Agent, or Firm*—Terrance L. Siemens

[57] ABSTRACT

A bag sealing and storage apparatus is made of a generally C-shaped clamp and a tubular locking portion that fits inside the clamp. On either side of the apex of the C, shoulders are extended outwardly to provide space within the clamp for a lapped or folded over part of the bag when it is sealed between the clamp and the locking portion. In addition, there is a protruding spine running along the clamping member that has a flanged end to allow it to be removably engageable with a slot in a cabinet door or the like. Thus, the user can reseal a bag and hang it off of the counter, drawer, or cabinet shelf. With the system shown in the present invention, a number of bags can be layered or overlapped to make a space efficient, out of the way, storage system for open, partially used bags.

4 Claims, 2 Drawing Sheets

FIG. 1
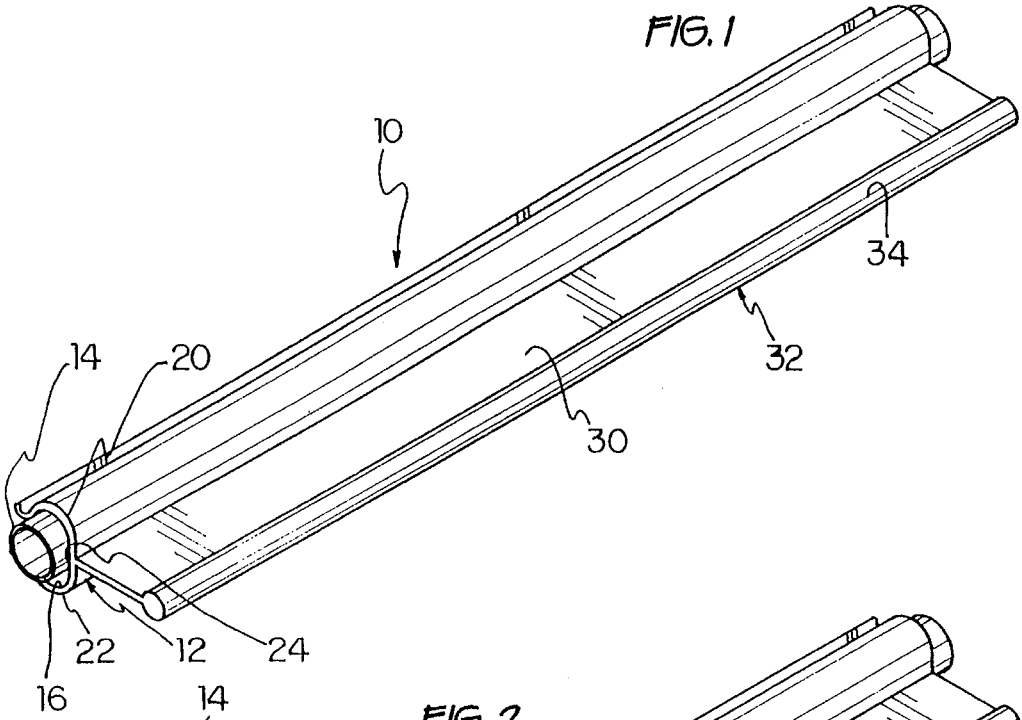
FIG. 2
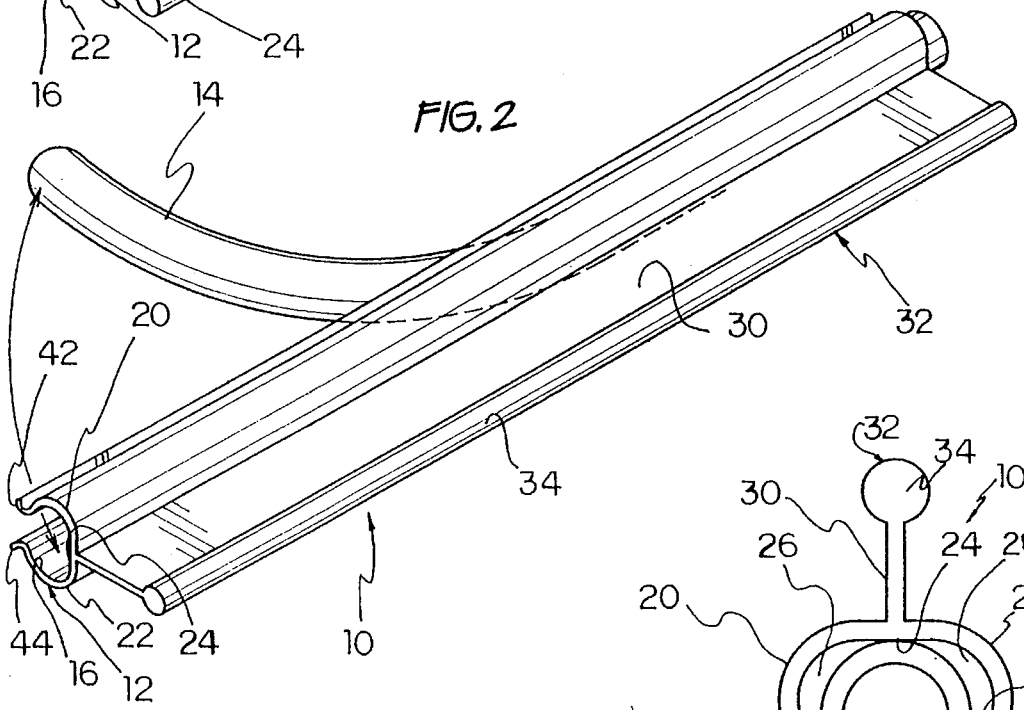
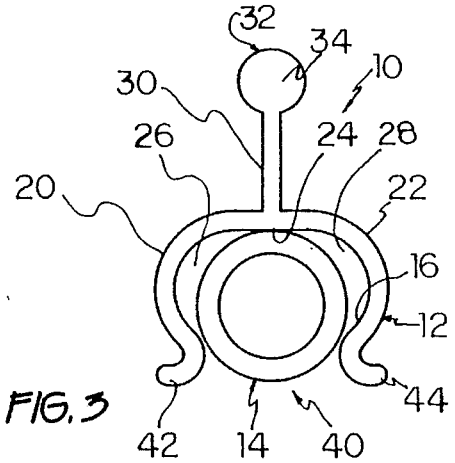
FIG. 3

BAG SEALING APPARATUS

BACKGROUND OF THE INVENTION

1. Field of the Invention

The present invention relates to closures. More specifically, it relates to closures for resealing bags. Even more specifically, it relates to a closure for a bag having a generally C-shaped receiving channel and a hollow tubular member that fits thereinto. The C-shaped receiver has broadened shoulders near its apex to allow the folded over or lapped portion of the bag to fit therein. More generally, the closure of the invention may be used to join any two pieces of overlapped cloth, paper, or plastic. Two adjoining pieces of tarpaulin might be joined with ease. The fields of food preparation, medicine, and packaging all stand to derive benefit from the unique features of this invention.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Many foodstuff and other items come packaged in bags. In many cases, the contents of the bag are not consumed in one sitting. A need exists to have a bag resealer that can keep the material contained in the opened bag from the ambient atmosphere, to prevent the unused contents from spoiling or going stale. The present invention seeks to address this problem by providing a bag resealing apparatus that allows for the easy and substantially complete closure of the lapped over portions of the bag by compressing them between a C-shaped receiver and a tubular member that is insertable thereinto.

As will be seen, the simplicity and effectiveness of my invention is not rivaled in the prior art. A number of relevant patents were uncovered in a search at the U.S. Patent and Trademark Office and they will be discussed hereinafter:

In U.S. Pat. No. 5,371,925 issued to Kim R. Sawatsky on Dec. 13, 1994 there is disclosed a bag sealing assembly wherein inner and outer clamp members interengage to hold together opposing sheets or the throat of a bag. The outer clamp member has a base portion which can include a card containing indicia, a magnet, or the like. This is unlike the present invention in that the cooperating surfaces of the clamping members are smoothly and continuously contiguous to one another when they are in the closed position.

U.S. Pat. No. 3,266,711 issued to June E. Song on Aug. 16, 1966 discloses a bag closure apparatus. In this device, unlike the present invention, the two clamping members are connected by a living hinge.

Another patent of interest is U.S. Pat. No. 5,190,252 issued to Lawrence A. Schrager on Mar. 2, 1993. This is a refuse bag support and is clearly unlike the present invention in that the cooperating channel member lacks the protrusion that allows the present invention to be removably attached to a cabinet door or the like.

Lastly, U.S. Pat. No. 5,209,442 issued to Hugh E. Buck et al. On May 11, 1993 discloses a gripper. As in the Schrager patent above, there is no teaching of the protrusion from a clasping member that allows the device to be removably attached to a channel set in a generally planar surface.

None of the above inventions and patents, taken either singly or in combination, is seen to describe the instant invention as claimed.

SUMMARY OF THE INVENTION

Briefly, the invention comprises a pair of cooperating members: a generally C-shaped clamp and a tubular locking portion that fits inside the clamp. On either side of the apex of the C, the shoulders are extended outwardly to provide space within the clamp for the lapped or folded over part of the bag when it is sealed between the clamp and the locking portion. Additionally, there is a protruding spine running along the clamping member that has a flanged end to allow it to be engaged in a cabinet mounted receiver for storage and easy removal. Thus, the user can reseal a bag and hang it up off of the counter, drawer, or cabinet shelf. With the system shown in the present invention, a number of bags can be layered or overlapped to make a space efficient, out of the way storage system for open, partially used bags.

Accordingly, it is a principal goal of the invention to provide a new and improved bag sealing apparatus device which overcomes the disadvantages of the prior art in a simple but effective manner.

It is a major object of this invention to provide a bag sealing apparatus wherein the contents of a partially empty bag can be completely and easily isolated from the ambient air.

It is another object of the invention to provide a bag sealing apparatus wherein the lapped over or folded portion of the bag is held between a C-shaped clamping member and a tubular locking portion.

It is another object of the invention to provide a bag sealing apparatus wherein the shoulders of the C-shaped clamp widen out proximate its apex, allowing for the bulk of the lapped over portion.

Yet another object of the invention is to provide a bag sealing apparatus wherein a protruding spine running along the length of the C-shaped clamp is interengageable with slots in a vertically or horizontally mounted receiving surface to allow the resealed bags to be stored in a space efficient manner.

Yet another object of the invention is to provide a bag sealing apparatus which allows the user to cut off excess portions of the bag after sealing.

Still another object of the invention is to provide a bag sealing apparatus which may be trimmed to specified lengths by the user so as to efficiently fit smaller bags.

Another object of the invention is to provide a bag sealing apparatus which is freezer safe, microwave safe, and not altered by boiling water.

Another object of the invention is to provide a bag sealing apparatus which eliminates freezer burn in frozen food packages opened and returned to the freezer.

Another object of the invention is to provide a bag sealing apparatus which will allow manufacturers to use larger bags for packaging thus eliminating the need for cardboard boxes.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 1 is an perspective view of the present invention in a closed position.

FIG. 2 is a perspective view of the present invention showing the tubular locking member partially removed from the C-shaped clamp member.

FIG. 3 is a front elevational view of the present invention.

DETAILED DESCRIPTION OF THE REFERRED EMBODIMENTS

Figure 4:
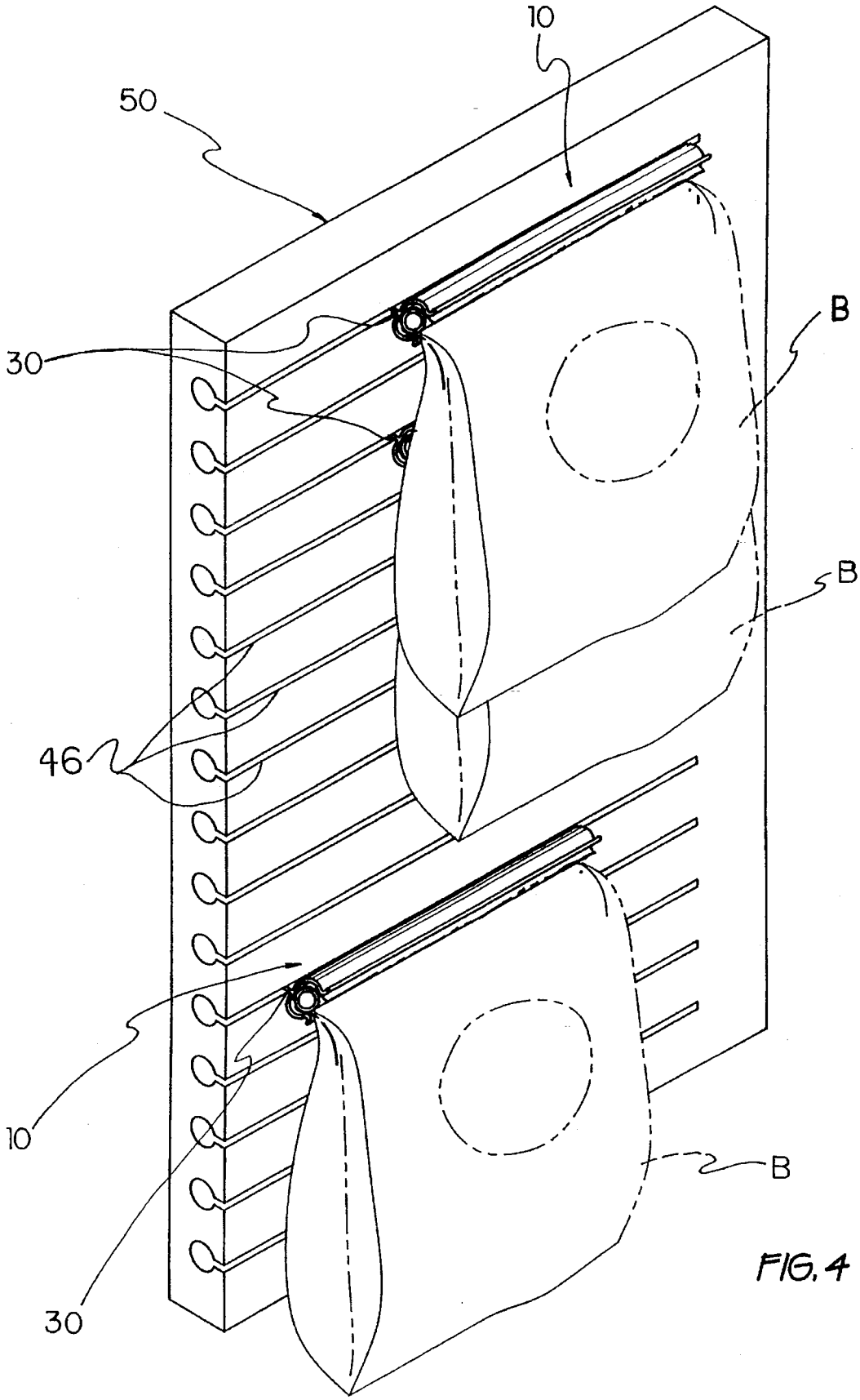
FIG. 4 is an environmental perspective view of the system that incorporates the present invention and allows for efficient storage of partially emptied bags.

The present invention is generally designated by 10 in the Figures. The two main portions are the C-shaped clamp member 12 and the tubular locking member 14. The C-shaped clamp 12 has an inner engagement area 16 dimensioned that the locking member 14 will fit therein and be held firmly. As can be seen in FIG. 3, the clamp member 12 does not have a smooth semi-circular cross-section, but instead describes more of an "omega" shape. Thus, a pair of shoulders 20 and 22 are described. They lie on either side of the apex 24 of the inner engagement area 16 and create a pair of spaces 26, 28 when the locking member 14 is within the engagement area 16. This can be best seen in FIG. 3. Distal the apex 24 is the engagement throat 40 of the C-shaped clamp member 12. On either side of the engagement throat 40 are two flanges 42, 44. These flanges guide the locking member 14 into the engagement area 16.

Running along the length of the C-shaped clamping member 12 is a protruding spine 30. The spine 30 is proximate to and continuous with the apex 24 of the C-shaped member. On the edge 32 of the spine 30, the edge 32 being distal from the apex 24, is a thickened area 34. This cooperates with slots 46, discussed hereinafter.

Turning to FIG. 4, the system for storing the resealed bags is shown. The system involves forming a plurality of grooves that are dimensioned to receive the protruding spine 30. These grooves are provided by horizontal slots 46, which are keyhole shaped. Keyhole shaped signifies that the configuration of the groove, when seen from the end or the left lateral side of FIG. 4, is a compound shape including a circular section and a straight section radiating from the circular section. The thickened area 34 of the spine 30 serves to hold the device 10, and thus the bags B, in place against the placement board 50. It should be understood that this board 50 could be attached to the inside of a cupboard door or the like, or could be attached to a wall. The receiver board could be mounted horizontally, as across a cabinet bottom, or vertically. Additionally, the board 50 could actually be integral to a cabinet, an exterior refrigerator surface or a wall.

From the foregoing description, one skilled in the art can easily ascertain the essential characteristics of this invention and, without departing from the spirit and scope thereof, can make various changes and modifications of the invention to adapt it to various usages and conditions. For example, the artisan could easily use this system to store large fertilizer bags or other heavy resealable packages. Also it would not be beyond the realm of the artificer to use the device to connect relatively large fabric expanses, such as tarpaulins and the like.

It is to be understood that the present invention is not limited to the sole embodiment described above, but encompasses any and all embodiments within the scope of the following claims:

I claim:

1. A bag sealing and storing apparatus comprising:

an elongated C-shaped clamping member having an inner receiving surface defining a receiving area, and an outer surface, said clamping member including an opening running along the length thereof and further including an inner surface apex running along the length thereof, said inner surface apex being located distal to said opening means, an elongated tubular locking member adapted to be fit into said receiving area of said clamping member and be held therein by said inner receiving surface, and a protruding spine located on said outer surface, said protruding spine extending substantially completely along the length of said elongated clamping member, and said protruding spine being located proximate said inner surface apex, wherein said protruding spine includes a thickened end, said thickened end located distal from said outer surface of said clamping member to form a gripping and manipulation aid for the device.

2. A bag sealing and storing apparatus comprising:

an elongated C-shaped clamping member having an inner receiving surface defining a receiving area, and an outer surface, said clamping member including an opening running along the length thereof and further including an inner surface apex running along the length thereof, said inner surface apex being located distal to said opening means, an elongated tubular locking member adapted to be fit into said receiving area of said clamping member and be held therein by said inner receiving surface, a protruding spine located on said outer surface, said protruding spine extending substantially completely along the length of said elongate clamping member, and where said protruding spine is located proximate said inner surface apex, and a planar member having a plurality of horizontal slots, said horizontal slots being adapted to receive said protruding spine, whereby a bag may be resealed by inserting the lapped portion or throat of the bag between said tubular locking member and said C-shaped clamping member, and the bag may be stored in a space-efficient manner by inserting the spine into said horizontal slot.

3. The bag sealing and storing apparatus as claimed in claim 2, wherein said horizontal slots are keyhole shaped in cross section.

4. The bag sealing and storing apparatus as claimed in claim 3, wherein said protruding spine includes a thickened end, said thickened end located distal from said outer surface of said clamping member, said thickened end adapted to fit inside the widened portion of said keyhole shaped horizontal slot.

* * * * *